United States Patent [19]

Isobe

[11] Patent Number: 4,576,490

[45] Date of Patent: Mar. 18, 1986

[54] MULTIHEAD SERIAL PRINTER

[75] Inventor: Minoru Isobe, Tokyo, Japan

[73] Assignee: Oki Electric Industry Co., Ltd., Tokyo, Japan

[21] Appl. No.: 679,904

[22] Filed: Dec. 10, 1984

[30] Foreign Application Priority Data

Dec. 14, 1983 [JP] Japan ..... 58-234311
May 14, 1984 [JP] Japan ..... 59-88376

[51] Int. Cl.[4] ..... B41J 3/44; B41J 3/58; B41J 3/04

[52] U.S. Cl. ..... 400/82; 400/149; 400/17; 400/18

[58] Field of Search ..... 400/149, 82, 17, 18

[56] References Cited

U.S. PATENT DOCUMENTS 4,389,126 6/1983 Homma et al. ..... 400/149

FOREIGN PATENT DOCUMENTS 2226394 12/1973 Fed. Rep. of Germany ..... 400/149
5775 1/1981 Japan ..... 400/82
6774 1/1982 Japan ..... 400/17
163670 9/1983 Japan ..... 400/82

OTHER PUBLICATIONS

Leontiades "Condensed Text Printing" IBM Technical Disclosure Bulletin vol. 25, No. 7B p. 3699 12/82.
Pawletko et al. "High Speed Printer" IBM Technical Disclosure Bulletin vol. 19, No. 9 pp. 3355-3356 2/77.

*Primary Examiner*—William Pieprz
*Attorney, Agent, or Firm*—Peter L. Berger

[57] ABSTRACT

The present invention relates to a multihead serial printer comprising a plurality of printing heads mounted on different carriages and having a high-speed printing mode in which a plurality of printing heads print different letters and a high-density printing mode in which a plurality of printing heads print different parts of one letter. These two printing modes can be changed over between each other. A plurality of carriages are independently supported by a common guide and the carriages are respectively movable in the line direction by different driving sources. At least one carriage comprises a shift mechanism for moving the printing head in the row direction along the surface of a platen.

5 Claims, 20 Drawing Figures

FIG. 14

| | | |
|---|---|---|
| 810103 | アオ ステレオ システム | 96755 |
| 801216 | アオ カラー テレビ | 84361 |
| 810203 | キ トースター | 71344 |
| ⋮ | ⋮ | ⋮ |

```
1000   REM
1010   A=0:B=0:C=0
1020   INPUT A
1030   INPUT B
1040   C=A+B
  ⋮      ⋮
```

| Payment | | Item | Reccipts | |
|---|---|---|---|---|
| Number of cases | Amount | | Number of cases | Amont |
| | | Cash | | |
| | | Transfer | | |
| | | -------- | | |
| | | -------- | | |
| | | --------- | | |

| | | | | | |
|---|---|---|---|---|---|
| La/c No. | | Div. | | Item | |
| Date | | | | Cord | |
| Alteration. No. | | | | | |

MULTIHEAD SERIAL PRINTER

BACKGROUND OF THE INVENTION (1) Field of the Invention

The present invention relates to a multihead serial printer which can be used as a printing apparatus for a terminal portion of a computer or a word processor.

(2) Description of the Prior Art

Japanese Patent Application Laid-Open Specification No. 163670/83 discloses three methods. According to the first method, wires of a single head are divided into three groups in the carriage spacing or line direction and the respective groups can be independently moved in the paper feeding or row direction. According to the second method, three printing heads are arranged on one carriage serially in the row direction. According to the third method, printing heads are mounted on three carriages and arranged serially in the row direction.

In each of the above-mentioned methods, the high-speed printing mode and the high-density printing mode can be changed over to each other, and these methods are characterized in that by one printer, alphabetic letters, numeral figures and kana letters can be printed at a high speed and Chinese characters (kanji) can be printed. Among the above-mentioned three methods, the third method is especially versatile and optimum printing operations can be performed for various printing formats.

However, the third method is defective in that since carriages are arranged with one another serially in the row direction, the size of the apparatus is increased. Furthermore, three pairs of guide shafts (6 shafts) are necessary, and since overlap printing by change of lines is carried out in the low-speed and high-density printing mode, the paper feeding quantity should be controlled very precisely. Accordingly, this method is defective in that the printing grade is low.

Japanese Patent Application Laid-Open Specification No. 161184/81 and U.S. Pat. No. 4,332,249 disclose techniques of attaching a motor to a carriage and moving the carriage along a guide shaft. According to these techniques, a pinion gear is rotated by the motor and is engaged with a rack gear mounted on the guide shaft to move the carriage. Precise moving of the carriage is attained. However, since only one carriage is arranged, high-speed printing cannot be performed, and high-density printing is difficult.

SUMMARY OF THE INVENTION

In accordance with the present invention, there is provided a multihead serial printer comprising a plurality of printing heads mounted on different carriages and having a high-speed printing mode in which a plurality of printing heads print different letters and a high-density printing mode in which a plurality of printing heads print different parts of one letter, the two printing modes being changeable over to each other, wherein a plurality of carriages are independently supported by a common guide, motors are attached to the respective carriages to move the carriages in the line direction, and at least one carriage comprises a shift mechanism for moving the printing head in the paper feed direction along the surface of a platen.

A primary object of the present invention having the above-mentioned structure is to provide a small printing apparatus in which a plurality of carriages moving independently are mounted on a common guide shaft.

Another object of the present invention is to provide a printer in which high-speed printing can be accomplished by arranging a plurality of printing heads.

Still another object of the present invention is to provide a printer in which high-density printing can be performed by arranging printing heads without the precise paper feed so that the printing heads can be shifted in the paper feed direction.

Still another object of the present invention is to provide a printer in which multi color printing can be performed by controlling the printing head.

BRIEF DESCRIPTION OF THE DRAWINGS

FIGS. 14(*a*) to 14(*d*) are diagrams showing examples of printing formats.

DETAILED DESCRIPTION OF THE PREFERRED EMBODIMENTS

The present invention for attaining the above-mentioned objects will now be described in detail with reference to embodiments illustrated in the accompanying drawings.

Figure 1:
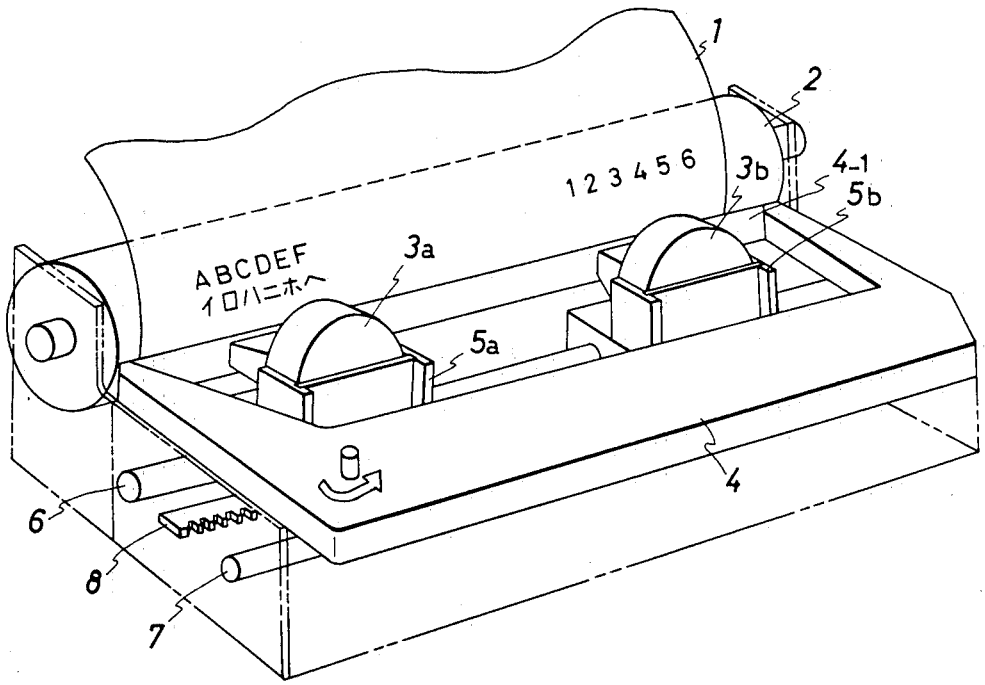
FIG. 1 is a perspective view illustrating a first embodiment of the present invention.

FIG. 1 is a perspective view showing a first embodiment of the present invention. Reference numeral 1 represents a paper sheet, reference numeral 2 represents a platen, reference numerals 3*a* and 3*b* represent printing heads, reference numeral 4 represents an ink ribbon cartridge, reference numeral 4-1 represents an ink ribbon derived from the cartridge 4, reference numerals 5*a* and 5*b* represent shift mechanisms for moving the printing heads 3*a* and 3*b* in the row direction along the surface of a platen, reference numerals 6 and 7 represent guide shafts and reference numeral 8 represents a rack. The printing heads 3*a* and 3*b* are arranged with each other serially in the line direction, and as described hereinafter, the printing heads 3*a* and 3*b* can be independently shifted in the row direction and moved in the line direction.

Figure 2:
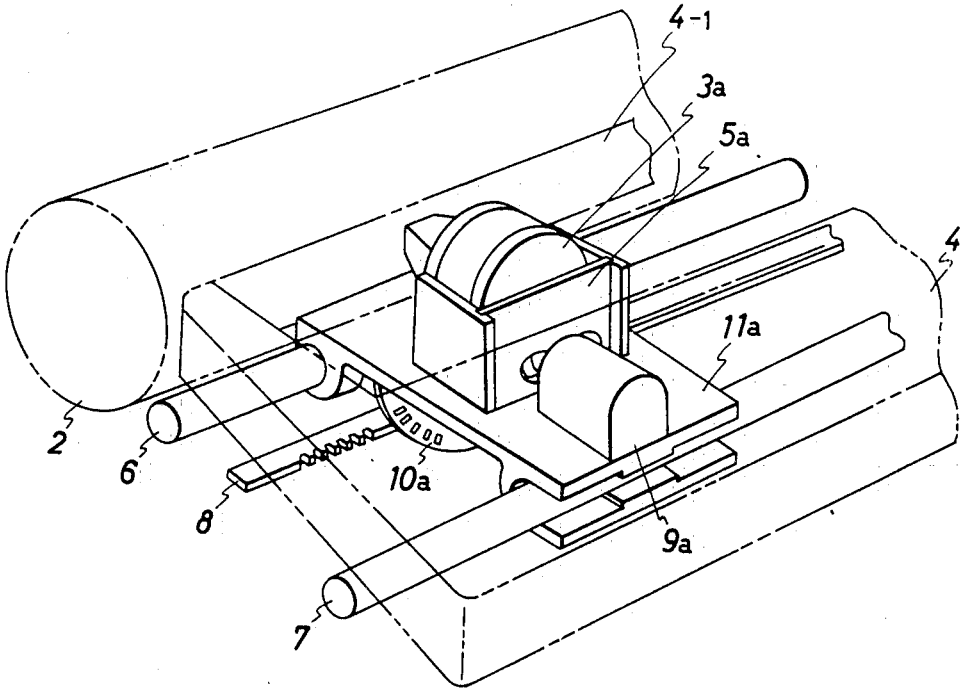
FIG. 2 is a perspective view illustrating a main part of a mechanism for shifting a printing head in the row direction and moving it in the line direction.

FIG. 2 is a perspective view illustrating a main part of a mechanism for shifting the printing head in the row direction and moving the printing head in the line direction. Reference numeral 9a represents a shifting motor acting as a driving source for operating the shift mechanism 5a and shifting the printing head 3a in the row direction, and reference numeral 10a represents a flat direct current brushless motor having a gear to be engaged with the rack 8. Reference numeral 11a represents a carriage installing the printing head 3a and the shift mechanism 5a. This flat direct current brushless motor 10a is attached to the carriage 11a. The carriage 11a is supported by the guide shafts 6 and 7 so that the carriage 11a can be moved in the line direction.

The operation of the first embodiment having the above-mentioned structure will now be described. When the flat direct current brushless motor 10a is driven, since the pinion (not shown) attached to the rotation shaft is engaged with rack 8, as described hereinafter, the carriage 11a receives a reaction force and is moved. Since the carriage 11a is guided and supported by the guide shafts 6 and 7, the moving direction of the carriage 11a is the carriage spacing direction (that is, the line direction). When the shifting motor 9a is driven, the printing head 3a is moved along the surface of the platen 2 in the paper feeding direction (that is, the row direction) by the shift mechanism 5a. Thus, the printing head 3a is shifted in the row direction and moved in the line direction. If a printing wire is projected while the printing head 3a is being moved in the line direction, an ink ribbon 4-1 of the ink ribbon cartridge 4 is transferred onto the paper sheet 1 to form a dot on the paper sheet 1.

The foregoing description has been made with respect to the printing head 3a, but also the printing head 3b can be shifted in the row direction and moved in the line direction in the same manner as described above. Since the printing head 3a and the printing head 3b are each shifted and moved by different motors, the printing heads 3a and 3b can be controlled quite independently. Advantages of this structure will now be described with reference to FIGS. 3 and 4.

Figure 3:
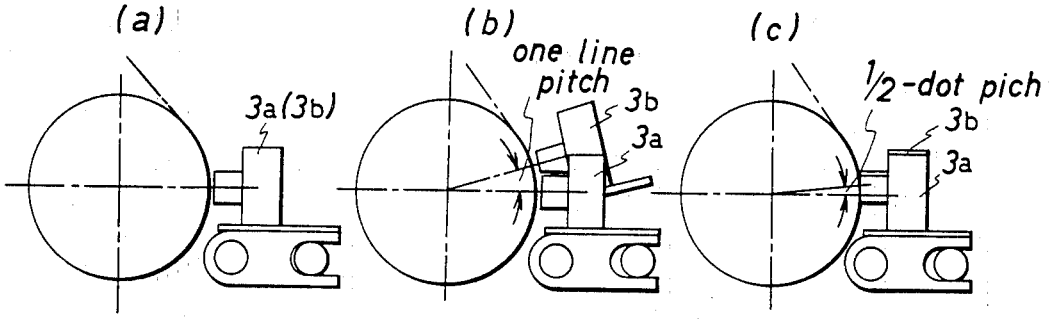
FIGS. 3(*a*) to 3(*c*) are diagrams showing various shifted states of a printing head.

FIG. 3 is a diagram illustrating various shifted states of the printing heads 3a and 3b. FIG. 3(*a*) shows the one-line printing state where the printing heads are drawn up in one row, FIG. 3(*b*) shows the two-line printing state where one printing head is shifted by one line, and FIG. 3(*c*) shows the high-density printing state where one printing head is shifted by a ½-dot pitch.

Printing procedures for several printing formats will now be described with reference to FIG. 4.

(1) Case where the printing region covers the entire paper surface (see the data list shown in FIG. 14(*a*)).

Figure 4:
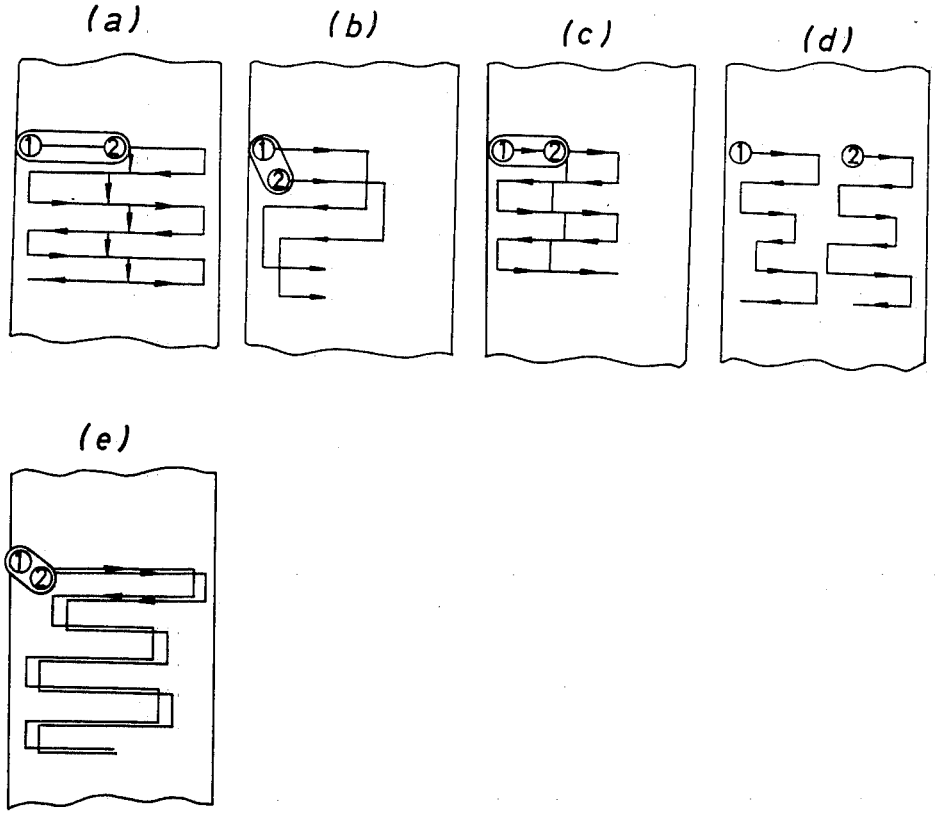
FIGS. 4(*a*) to 4(*e*) are diagrams showing printing procedures for various printing formats.

The printing heads 3a and 3b are kept in the one-line printing state shown in FIG. 3(*a*), and printing is carried out while the spacing operation is performed from the positions (1) and (2) shown in FIG. 4(*a*) in the direction indicated by the arrow.

(2) Case where the printing region is partially located on one side of the paper surface or on a part of the paper surface (see the program list shown in FIG. 14(*b*)).

The printing heads 3a and 3b are kept apart in the two-line printing state shown in FIG. 3(*b*), and printing is carried out while the spacing operation is performed from the positions (1) and (2) shown in FIG. 4(*b*) in the direction indicated by the arrow.

Incidentally, in this case, printing may be performed as shown in FIG. 4(*c*) according to the printing procedure of the above-mentioned case (1). However, since the time required for twice performing two-line feeding is longer than the time required for once performing two-line feeding, the above-mentioned printing procedure is preferred.

(3) Case where the printing region is separated into both sides of the paper surface (see the receipt and payment table shown in FIG. 14(*c*)).

The printing heads 3a and 3b are kept in the one-line printing state shown in FIG. 3(*a*), and printing is carried out while the spacing operation is performed from the positions (1) and (2) shown in FIG. 4(*c*) in the direction indicated by the arrow. In this case, the first printing head which completes the printing operation is shifted to the printing position of the next line at this position until the other printing head completes the printing operation.

(4) Case where the printing region is dispersed in one line or in the row direction (see the deposit item change table shown in FIG. 14(*d*)).

The printing heads 3a and 3b are kept in the one-line printing state shown in FIG. 3(*a*), and shortest printing is carried out while the spacing operation is performed from the positions (1) and (2) shown in FIG. 4(*d*) in the direction indicated by the arrow.

(5) Case where high-density printing is performed for letter quality printing.

The printing heads 3a and 3b are kept apart in the high-density printing state shown in FIG. 3(*c*), and printing is carried out while the spacing operation of the printing heads 3a and 3b is performed from the close positions (1) and (2) shown in FIG. 4(*e*) in the direction indicated by the arrow. In this case, the respective printing heads are kept apart in the row direction by a quantity obtained by dividing the number of the printing heads into one dot pitch (in this embodiment, since the number of the printing heads is 2, the printing heads are shifted by ½ dot).

Figure 5:
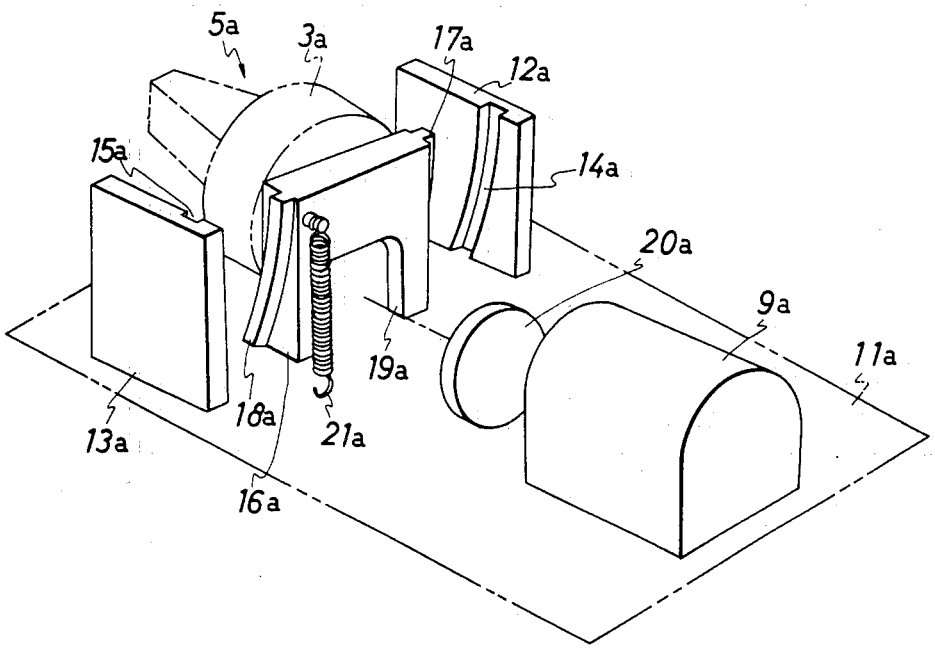
FIG. 5 is a fragmentary perspective view illustrating a shift mechanism.

FIG. 5 is a fragmentary respective view illustrating the shift mechanism 5a. As shown in FIG. 5, side frames 12a and 13a and the shifting motor 9a are secured on the carriage 11a. Curved grooves 14a and 15a having a center of curvature at the center of the platen 2 (see FIG. 2) are formed on the inner wall sides of the side frames 12a and 13a. Projections 17a and 18a of a guide 16a are fitted in the curved grooves 14a and 15a and the guide 16a is capable of turning along the surface of the platen. A substantially ⊐-shaped cam follower surface 19a is formed in the central lower portion of the guide 16a, and an eccentric cam 20a attached to the rotation shaft of the shifting motor 9a is contacted with the cam follower surface 19a. The printing head 3a is secured to the guide 16a and gripped between the side frames 12a and 13a. The guide 16a is pulled downward by a reset spring 21a.

Figure 6:
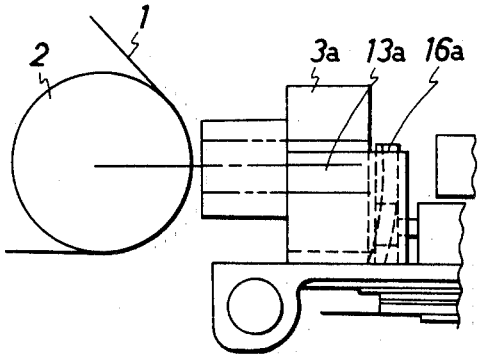
FIG. 6 is a side view illustrating the state where a printing head is not shifted.
Figure 7:
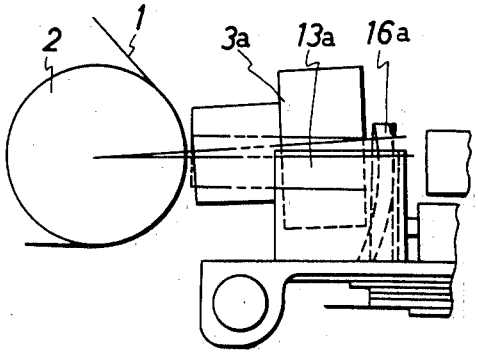
FIG. 7 is a side view illustrating the state where a printing head is shifted.

In the above-mentioned structure, when the eccentric cam 20a is rotated by driving the shifting motor 9a, the guide 16a contacted with the cam follower surface 19a is moved vertically. Since the projections 17a and 18a of the guide 16a are fitted in the grooves 14a and 15a of the side frames 12a and 13a, the guide 16a and the printing head 3a are rotated along the surface of the platen. Accordingly, the distance between the platen 2 (see FIG. 2) and the printing head 3a is kept apart and is constant irrespective of the shift quantity. FIG. 6 shows the state where the printing head 3a is not shifted and FIG. 7 shows the state where the printing head 3a is shifted.

Figure 8:
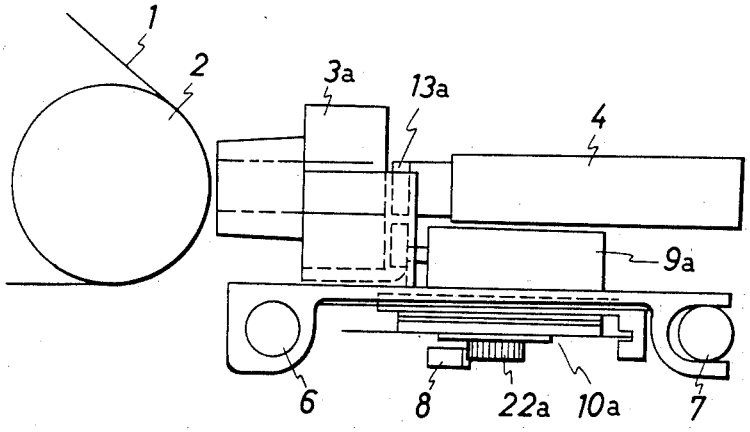
FIG. 8 is a side view illustrating a carriage driving mechanism.
Figure 9:
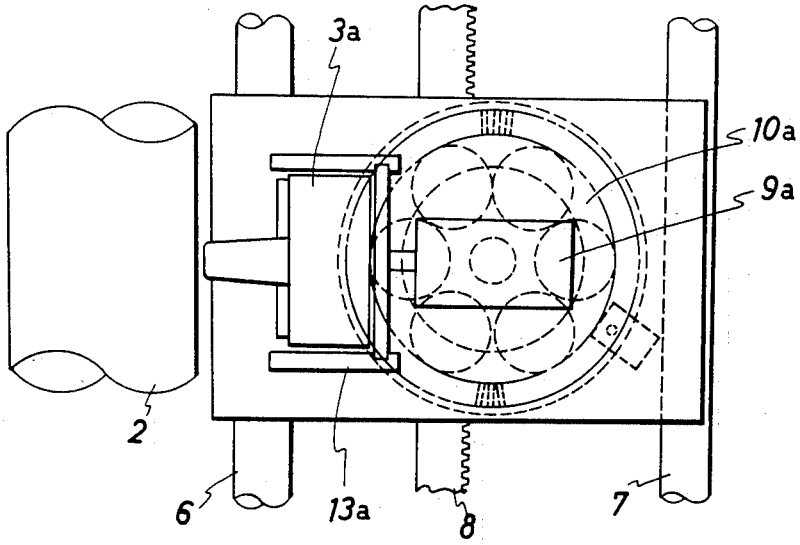
FIG. 9 is a plane view illustrating a carriage driving mechanism.

FIGS. 8 and 9 are side and plane views showing a carriage driving mechanism. The flat brushless motor 10*a* is arranged in the lower portion of the printing head 3*a*, and a pinion 22*a* attached to the shaft (not shown) of the flat direct current brushless motor 10*a* is engaged with the rack 8.

Figure 10:
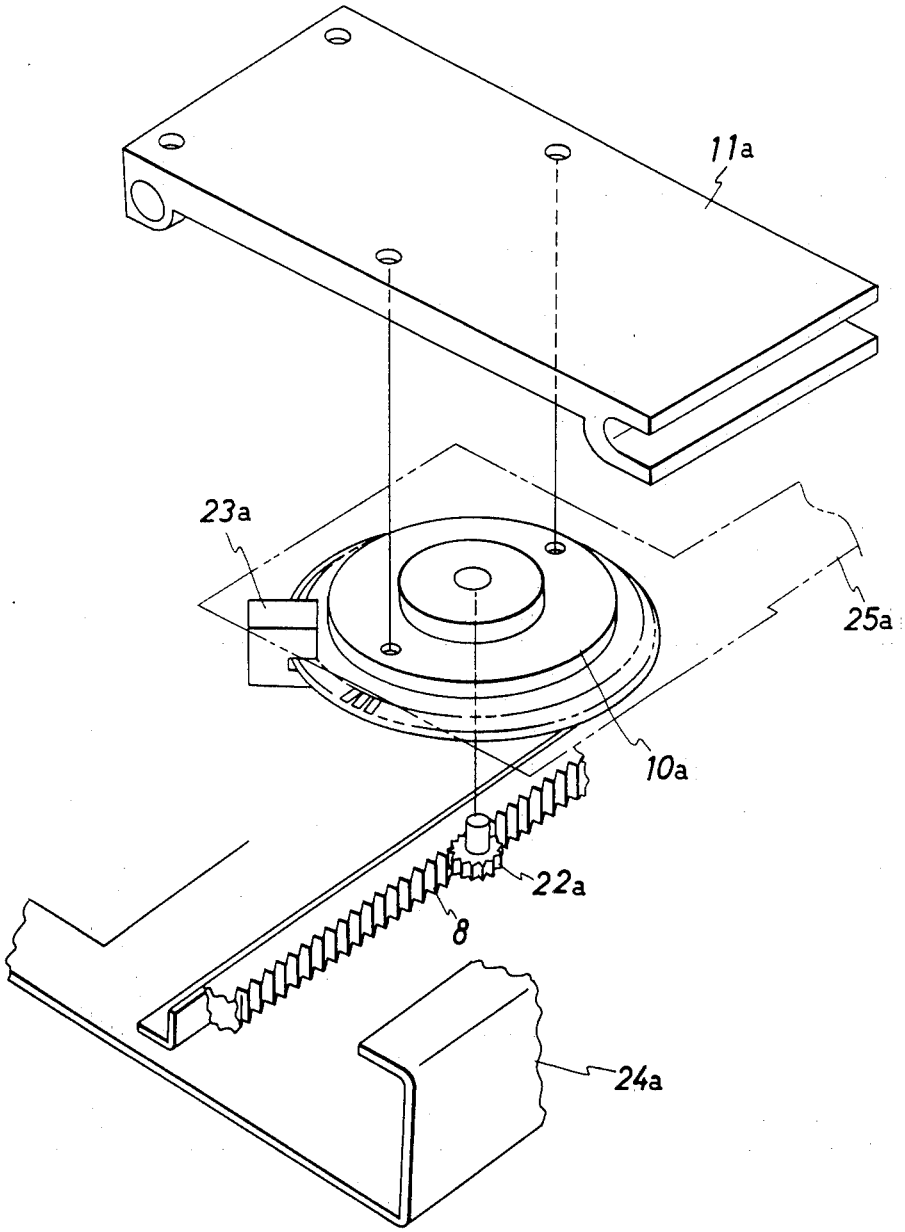
FIG. 10 is a fragmentary perspective view illustrating a carriage driving mechanism in detail.

FIG. 10 is a fragmentary perspective view illustrating the carriage driving mechanism in more detail. Reference numeral 23*a* represents a light sensor for detecting the rotation angle of the flat direct current brushless motor 10*a*, reference numeral 24*a* represents a lower frame for fixing the rack 8, and reference numeral 25*a* represents a flexible cable for electrically connecting members mounted on the carriage 11*a* such as the printing head 3*a* (see FIG. 2), shifting motor 9*a* (see FIG. 2), flat direct current brushless motor 10*a* and light sensor 23*a* to a control circuit not shown in the drawings.

In this mechanism, the flat direct current brushless motor 10*a* is driven by electric power supplied through the flexible cable 25*a* and the pinion 22*a* is rotated by driving the motor 10*a*. By rotation of the pinion 22*a*, a signal indicating the rotation angle is put out from the light sensor 23*a*, and the carriage 11*a* is moved by a reaction force from the rack 8.

The shift mechanism shown in FIGS. 5, 6 and 7 and the carriage driving mechanism shown in FIGS. 8, 9 and 10 are those for the printing head 3*a*, and the same mechanisms are similarly arranged for the printing head 3*b*.

Various modifications may be adopted in the present invention, and the present invention is not limited to the above-mentioned first embodiment.

Figure 11:
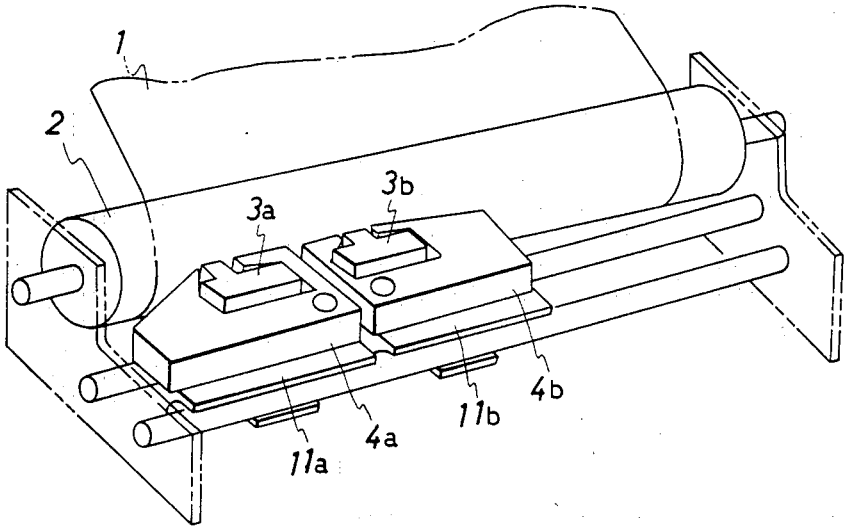
FIG. 11 is a perspective view illustrating a second embodiment of the present invention.

In a second embodiment shown in FIG. 11, two ink ribbon cartridges 4*a* and 4*b* are mounted on the independent carriages 11*a* and 11*b*, respectively. In this embodiment, it is preferred that as shown in FIG. 11, the thickness of the right side of the ink ribbon cartridge 4*a* and the left side of the ink ribbon cartridge 4*b* be reduced as much as possible so that each of the printing heads 3*a* and 3*b* are brought close to each other. If this arrangement is adopted such as illustrated in FIGS. 4(*b*) and 4(*e*), the approach distance for printing can be decreased.

Where the platen is not cylindrical but has a plate-like shape, it is sufficient if the printing head is moved vertically to the carriage. In this case, the grooves 14*a* and 15*a* shown in FIG. 5 are linear, respectively, to the projections 17*a* and 18*a*.

From the veiwpoint of the size, weight, cost and electric power consumption of the apparatus, it is practically preferred that two pairs each of printing heads and carriages be arranged. Of course, for high-speed printing and high-density printing, more than three pairs each of printing heads and carriages may be arranged.

Figure 12:
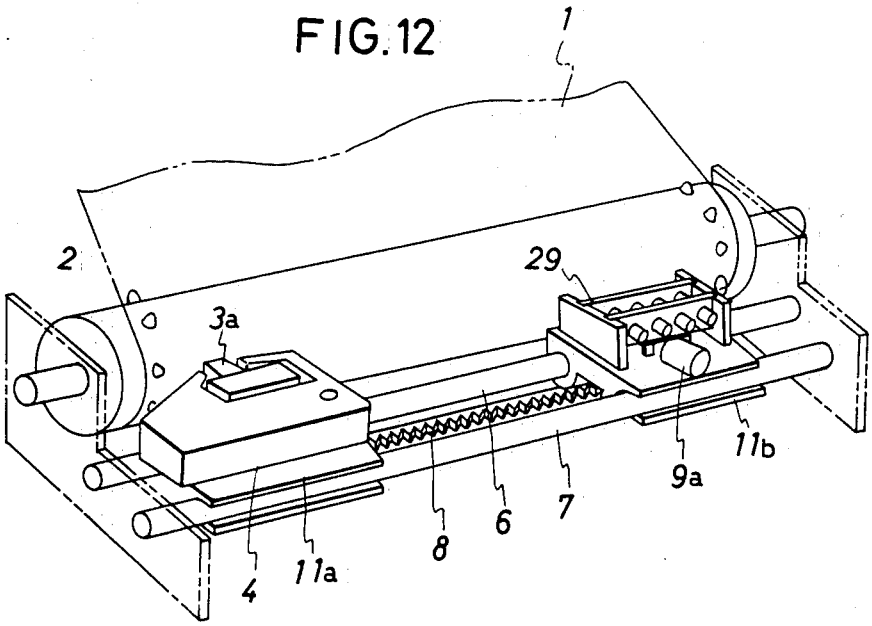
FIG. 12 is a perspective view illustrating a third embodiment of the present invention.
Figure 13:
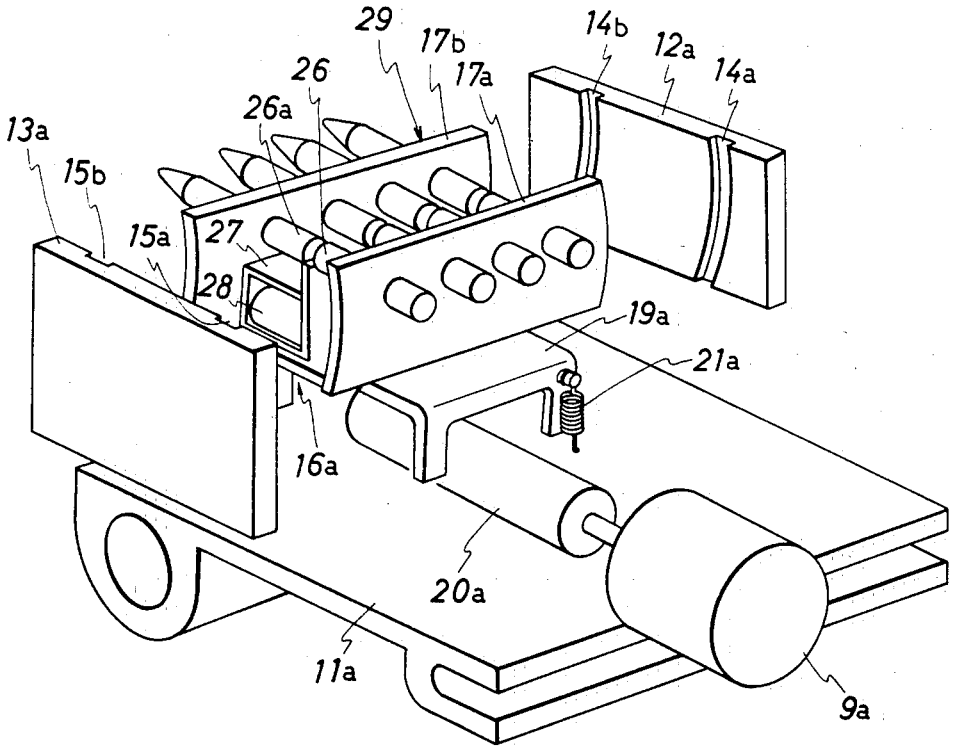
FIG. 13 is a perspective view illustrating a row direction shift mechanism in the third embodiment.

A third embodiment will now be described with reference to FIGS. 12 and 13. FIG. 12 is a perspective view, and FIG. 13 is a perspective view illustrating a main part of a mechanism for performing the shifting operation in the row direction. In this embodiment, an ordinary printing head is disposed on one side and a pen type printing head having a plurality of pens is disposed on the other side. The pen type printing head 29 comprises pens 26 which are arranged so that the pens 26 can be moved on the follower 19*a* together with the guide 16*a*. Reference numeral 27 represents an actuator having one end engaged with a groove 26*a* of the pen 26 and reference numeral 28 represents a magnet for attracting the actuator 27. If the actuator 27 is moved by the attracting action of the magnet 28, the pen 26 is pressed against the platen 2.

The shift mechanism for shifting the pen type printing head 29 in the row direction has the same structure as that of the shift mechanism adopted in each of the foregoing embodiments and contains curved grooves 14*a*, 14*b*, 15*a*, 15*b*.

As is apparent from the foregoing description, according to the present invention, since a plurality of printing heads are arranged with one another serially in the spacing direction, a space substantially equal to the space for one single head is sufficient and a pair of guide shafts is sufficient. Therefore, the size of the apparatus can be diminished. Moreover, since a plurality of printing heads are arranged, high-speed printing is possible.

Furthermore, since the printing heads can be shifted, the paper feed operation can be performed without the precise paper feed, and therefore, the position error is diminished and high-speed printing can be performed precisely.

Still further, if the printing region is appropriately divided, substantially equal loads are imposed on the respective printing heads. Therefore, wearing of a specific printing head or rising of the temperature in a specifc printing head is prevented, and an effect of diminishing vibrations or noises can be attained.

With an ordinary dot printing head loaded on one carriage and a pen type printing head loaded on the other carriage, letters can be printed by the ordinary dot printing head and figures or patterns can be drawn by the pen type printing head. Accordingly, letters can be printed at a high-speed and figures or patterns can be drawn by smooth lines.

Moreover, since the pen can be vertically moved by a distance corresponding to about two letters, a small figure, for example, a small circle, can be drawn efficiently without moving a paper sheet.

What is claimed is:

1. A multihead serial printer comprising a plurality of printing heads mounted on a plurality of different carriages, means defining a high-speed printing mode in which a plurality of printing heads print different letters, means defining a high-density printing mode in which a plurality of printing heads print different parts of one letter, and means for changing over between said high-speed printing mode and said high-density printing mode, wherein said plurality of carriages are independently supported by a common guide, each of said carriages has mounted thereon a printing head and is respectively movable in a letter spacing direction by a different and independent driving motor, and at least one carriage comprises a shift mechanism for independently moving a printing head mounted thereon along a surface of a platen in a paper feed direction a selectable distance relative to said other carriage before its driving motor moves the carriage in said letter spacing direction said selectable movement in the paper feed direction enabling either printing of a single letter by both print heads in the high density mode or printing of two lines simultaneously in the high speed mode.

2. A multihead serial printer as set forth in claim 1, including a pen-type printing head mounted on one carriage and a shift mechanism arranged to move the pen-type printing head along the surface of the platen in the paper feed direction.

3. A multihead serial printer as set forth in claim 1, including an ink ribbon cartridge mounted on each carriage for providing each printing head with an ink ribbon.

4. A multihead serial printer as set forth in claim 1 wherein the shift mechanism comprises a shifting motor and includes means responsive to the shifting motor for moving the printing head in the paper feed direction in conformance with the surface of the platen.

5. A multihead serial printer as set forth in claim 4 wherein the means responsive to the shifting motor comprises a cam means.

* * * * *